US011388944B2

(12) United States Patent
Connelly et al.

(10) Patent No.: US 11,388,944 B2
(45) Date of Patent: Jul. 19, 2022

(54) CHIN STRAP

(71) Applicant: Under Armour, Inc., Baltimore, MD (US)

(72) Inventors: Timothy Connelly, Baltimore, MD (US); Jedd A. Komlos, Baldwin, MD (US)

(73) Assignee: Under Armour, Inc., Baltimore, MD (US)

( * ) Notice: Subject to any disclaimer, the term of this patent is extended or adjusted under 35 U.S.C. 154(b) by 307 days.

(21) Appl. No.: 16/381,364

(22) Filed: Apr. 11, 2019

(65) Prior Publication Data

US 2019/0231017 A1 Aug. 1, 2019

Related U.S. Application Data

(63) Continuation of application No. 14/797,907, filed on Jul. 13, 2015, now Pat. No. 10,292,447.

(60) Provisional application No. 62/023,273, filed on Jul. 11, 2014.

(51) Int. Cl.

| | |
|---|---|
| ***A42B 3/08*** | (2006.01) |
| ***A41D 13/05*** | (2006.01) |
| ***A42B 3/20*** | (2006.01) |

(52) U.S. Cl.

CPC ..... *A42B 3/08* (2013.01); *A41D 13/05* (2013.01); *A41D 13/0568* (2013.01); *A42B 3/205* (2013.01)

(58) Field of Classification Search

CPC .... A43B 3/205; A41D 13/05; A41D 13/0568; A42B 3/08

See application file for complete search history.

(56) References Cited

U.S. PATENT DOCUMENTS

| | | | | |
|---|---|---|---|---|
| 2,250,275 A * | 7/1941 | Riddell | A42B 3/08 2/424 |
| D132,184 S * | 4/1942 | Lyon | D29/108 |
| 2,867,811 A * | 1/1959 | Jones | A42B 3/08 2/421 |
| 3,118,443 A * | 1/1964 | Dykinga | A61H 1/0218 602/17 |
| 3,132,345 A * | 5/1964 | Keith | A42B 3/20 2/9 |

(Continued)

FOREIGN PATENT DOCUMENTS

WO 2006089098 A1 8/2006

*Primary Examiner* — Richale L Quinn

(74) *Attorney, Agent, or Firm* — Edell, Shapiro & Finnan, LLC

(57) ABSTRACT

A chin strap includes a protective shell including a curved and convex contour extending between lengthwise ends of the shell, the shell further including a first curved edge extending between the lengthwise ends of the shell and a second curved edge extending between the lengthwise ends of the shell. A cross-section along a lengthwise central axis of the chin strap defines a first shell portion including the first curved edge and a second shell portion including the second curved edge. The first shell portion of the cross-section defines a first surface area between the lengthwise central axis and the first curved edge, and the second shell portion of the cross-section defines a second surface area between the lengthwise central axis and the second curved edge, where the first surface area is less than the second surface area.

15 Claims, 5 Drawing Sheets

(56) References Cited

U.S. PATENT DOCUMENTS 3,187,342 A * 6/1965 Aileo ..... A42B 3/08 2/421
3,619,813 A * 11/1971 Marchello ..... A42B 3/08 2/421
3,787,895 A * 1/1974 Belvedere ..... A42B 3/20 2/9
4,051,556 A * 10/1977 Davenport ..... A42B 3/08 2/421
D253,916 S * 1/1980 Vitaloni ..... D29/105
4,646,368 A * 3/1987 Infusino ..... A42B 3/08 2/421
4,651,356 A * 3/1987 Zide ..... A42B 3/08 2/421
5,794,274 A * 8/1998 Kraemer ..... A42B 3/205 2/421
6,081,932 A * 7/2000 Kraemer ..... A42B 3/08 2/421
6,298,483 B1 * 10/2001 Schiebl ..... A42B 3/0433 2/421
6,324,701 B1 * 12/2001 Alexander ..... A42B 3/08 2/421
6,481,024 B1 * 11/2002 Grant ..... A42B 3/08 2/421
6,499,147 B2 * 12/2002 Schiebl ..... A42B 3/0433 2/414
D526,449 S 8/2006 Dawson et al.
7,152,253 B2 * 12/2006 Abelman ..... A42B 3/08 2/421
D606,707 S 12/2009 Schiebl
7,735,160 B1 * 6/2010 Schiebl ..... A42B 3/08 2/425
D620,205 S * 7/2010 Schiebl ..... D29/122
7,895,677 B1 * 3/2011 Schiebl ..... A42B 3/08 2/421
7,921,475 B2 * 4/2011 Nascimento ..... A42B 3/08 2/410
8,006,322 B1 * 8/2011 Schiebl ..... A42B 3/205 2/421
8,020,562 B2 * 9/2011 Navarrette, Jr. ..... A63B 71/085 128/861
D657,497 S * 4/2012 Schiebl ..... D29/108
8,621,671 B1 * 1/2014 Schiebl ..... A42B 3/205 2/421
8,959,668 B1 * 2/2015 Ganes ..... A42B 3/205 2/421
9,345,281 B1 * 5/2016 Schiebl ..... A42B 3/205
9,756,889 B2 * 9/2017 Infusino ..... A42B 3/08
10,076,149 B2 * 9/2018 Ross ..... A42B 3/228
10,098,405 B2 * 10/2018 Ross ..... A42B 3/18
D848,075 S * 5/2019 Szasz ..... D29/108
2007/0124842 A1 * 6/2007 Nascimento ..... A42B 3/08 2/9
2010/0212674 A1 * 8/2010 Navarrette, Jr. ..... A42B 3/205 128/861
2010/0319109 A1 * 12/2010 Field ..... A42B 3/08 2/421
2013/0152281 A1 * 6/2013 Kravitz ..... A42B 3/205 2/411
2014/0068844 A1 * 3/2014 Infusino ..... A42B 3/08 2/421
2014/0143937 A1 * 5/2014 Cram ..... A42B 3/04 2/410
2016/0007670 A1 * 1/2016 Connelly ..... A41D 13/0568 2/421
2017/0209767 A1 * 7/2017 Tryner ..... A42B 3/08
2017/0265557 A1 * 9/2017 Mercado, Jr. ..... A42B 3/16
2018/0084857 A1 * 3/2018 Schiebl ..... A42B 3/08
2018/0084858 A1 * 3/2018 Schiebl ..... A42B 3/205
2018/0092426 A1 * 4/2018 Hall ..... A42B 3/205
2018/0213876 A1 * 8/2018 Parsons ..... A42B 3/205

* cited by examiner

CHIN STRAP

CROSS-REFERENCE TO RELATED APPLICATION

This application is a continuation of U.S. patent application Ser. No. 14/979,907, filed Jul. 13, 2015, which claims priority to and is based on U.S. Provisional Patent Application No. 62/023,273, filed Jul. 11, 2014, entitled "Chin Strap," the entire disclosure of which is incorporated herein by reference.

FIELD

The present invention relates to a chin strap used in sports and other physical activities.

BACKGROUND

Helmets are typically used in sports (such as football, lacrosse, hockey, etc.) or other physical types of activities (e.g., police riot gear) for protecting a user's head during such activities. A chin strap, connected to the helmet, is also provided to assist in securing a helmet to a user's head and/or protect the user's chin and jaw from abrasive or other contacting forces associated with the physical activity in which the user is engaged. The chin strap typically includes one or more flexible straps tethered to a central cup. The distal ends of the flexible straps include fasteners that secure the chin strap to the helmet such that the cup is generally aligned with the users chin. The flexible straps can be adjustable in length to facilitate adjustment of a distance from which the chin strap extends from the helmet to provide a proper chin alignment, as well as a comforting fit for the user wearing the helmet.

The cup of such conventional chin straps includes a symmetrical cup, i.e., a cup defining equal surface areas on opposite sides of the cup's central longitudinal or lengthwise axis. This conventional cup is prone to slippage caused by contact during game play. That is, when a force is applied to the helmet (e.g., via helmet-to-helmet contact), the helmet will shift/rotate on the wearer's head. In addition, while the adjustability feature for the straps of the chin strap is desirable to facilitate a precise comfort fit for different users of a helmet (e.g., users having different facial contours and configurations), this can also result in a user adjusting the strap lengths so that the chin strap is loosely fit over the user's chin, resulting in the potential for the chin strap to slip from and/or provide less protection to the user's chin when engaging in the physical activity.

Accordingly, it would be desirable to provide a chin strap having a more secure fit, and that is effective to retain the position (e.g., rotational position) of the helmet on the wearer's head during game play.

SUMMARY

In an embodiment, a chin strap or guard comprises a protective shell and a cushion member. The shell defines an outer surface that faces away from a user's chin during use of the chin strap, the outer surface including a curved and convex contour extending between lengthwise ends of the shell. The shell further includes a first curved edge extending between the lengthwise ends of the shell and a second curved edge extending between the lengthwise ends of the shell. The cushion member is secured to the inner surface of the shell opposite the shell outer surface. The cushion member includes an interior surface having a curved and concave contour that extends between lengthwise ends of the cushion member such that the cushion member engages with the user's chin during use of the chin strap.

A cross-section along a lengthwise central axis of the chin strap defines first and second outer surface shell portions that are asymmetrical such that the first outer surface shell portion of the cross-section including the first curved edge defines a first area that is less than a second area defined by the second outer surface shell portion of the cross-section including the second curved edge.

During use, the chin strap is oriented in relation to a user's chin such that the second curved edge and greater surface area defined by the second outer surface shell portion are located beneath the user's chin.

In another embodiment, a chin strap comprises a protective shell including a curved and convex contour extending between lengthwise ends of the shell, the shell further including a first curved edge extending between the lengthwise ends of the shell and a second curved edge extending between the lengthwise ends of the shell. A cross-section along a lengthwise central axis of the chin strap defines a first shell portion including the first curved edge and a second shell portion including the second curved edge. The first shell portion of the cross-section defines a first surface area between the lengthwise central axis and the first curved edge, and the second shell portion of the cross-section defines a second surface area between the lengthwise central axis and the second curved edge. The first surface area is less than the second surface area.

In a further embodiment, a chin strap comprises a protective shell including a curved and convex contour extending between lengthwise ends of the shell, the shell further including a first curved edge extending between the lengthwise ends of the shell and a second curved edge extending between the lengthwise ends of the shell. At least a portion of the second curved edge of the shell extends further in distance from a leading forward edge of the shell than at least a portion of the first curved edge of the shell.

The above and still further features and advantages of embodiments of the present invention will become apparent upon consideration of the following detailed description thereof, particularly when taken in conjunction with the accompanying drawings wherein like reference numerals in the various figures are utilized to designate like components.

BRIEF DESCRIPTION OF THE DRAWINGS

Like reference numerals have been used to identify like elements throughout this disclosure.

DETAILED DESCRIPTION

Figure 1A:
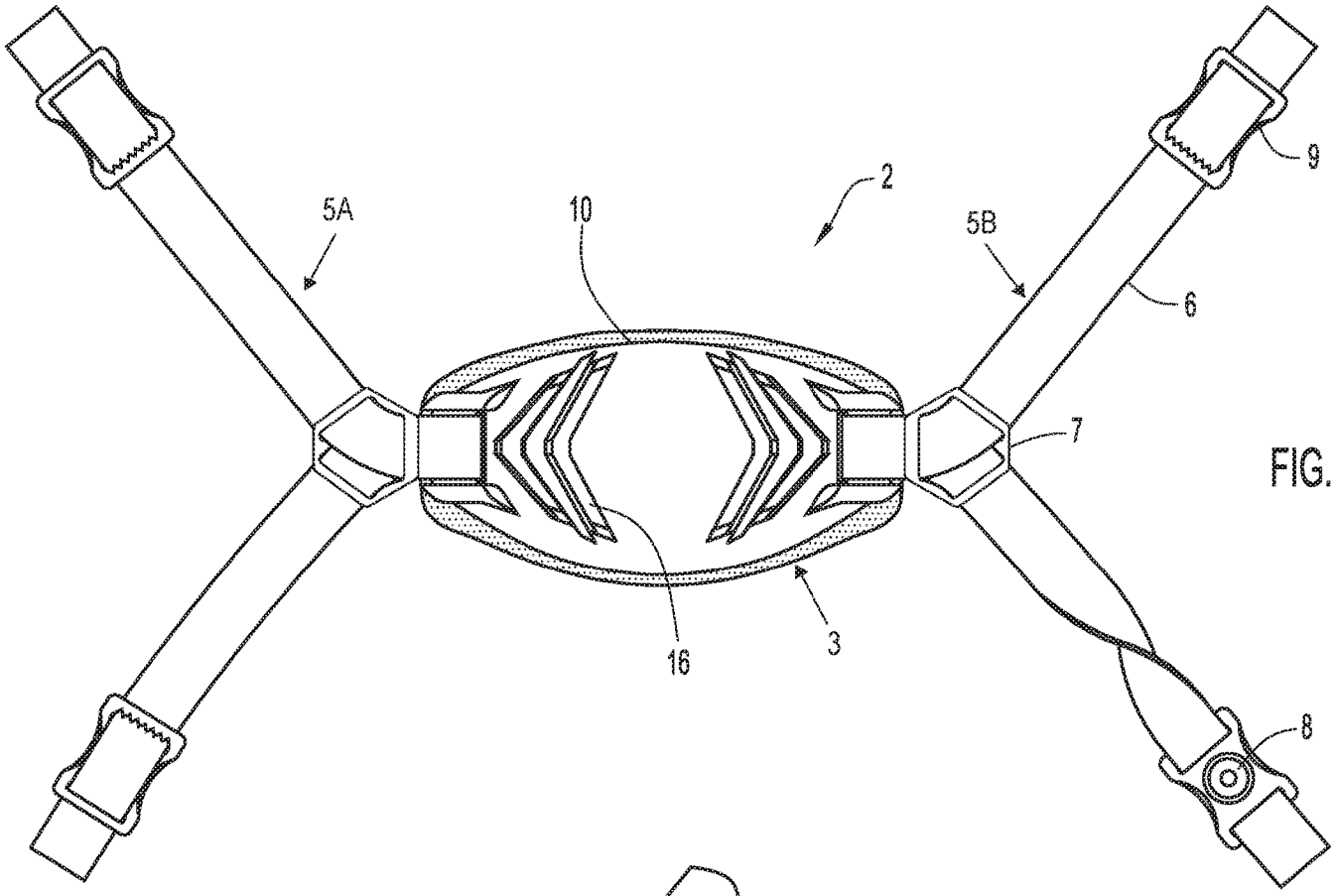
FIG. 1A is a front view in perspective of an example embodiment of a chin strap in accordance with the present invention.

As described herein, a chin strap for use with helmets has a configuration that is asymmetrical in relation to a lengthwise dimension of the chin strap, where a second or lower portion of the chin strap includes more structural material and has a larger outer surface area in relation to a first or upper portion of the chin strap. This configuration of the chin strap provides for enhanced protection of the user's chin, with the lower portion of the chin strap extending to a greater extent beneath the user's chin in relation to conventional or other types of chin straps and further preventing, inhibiting or limiting movement of the chin strap from disengaging with the user's chin during use.

Referring to FIGS. 1-6, the chin strap 2 may include a cup 3 and connector members 5A, 5B coupled thereto. The cup 3 of the chin strap 2 is configured to receive and/or cradle the chin of the wearer. In the illustrated embodiment, the cup 3 includes an outer protective layer and an inner cushion layer. Specifically, the cup 3 includes a generally rigid (e.g., hard), outer protective shell 10 that defines an outer surface of the chin strap cup 3 and an inner cushion member 30 that is secured to an interior surface of the shell 10 and faces toward the user to engage with a chin of the user wearing a helmet to which the chin strap is attached.

The shell 10 is made of a suitably hard yet lightweight material (e.g., nylon) to absorb and sustain impact forces during use without significant wear and tear to the shell 10. The inner cushion member 30, being configured to directly engage with the user's chin, is made of a softer and more flexible material in relation to the shell 10 so as to provide a cushioning effect as well as further absorption of any impact forces applied to the chin strap 2 when worn by the user. By way of example, the inner cushion member 30 may be formed of a compressible material such as ethylene vinyl acetate foam, polyurethane foam, etc.

The protective shell 10 has a curved and generally cross-sectional convex contour that extends in a lengthwise direction of the shell 10 such that the shell generally corresponds with the contour of a user's chin. The shell 10 defines a first lengthwise end 11*a* and a second lengthwise end 11*b* (see FIG. 2). The cushion member 30 also has a curved and generally cross-sectional convex contour that extends in a lengthwise direction of the cushion member 30, where the cushion member 30 is further suitably dimensioned to be aligned with and fit (e.g., press fit) within and against the interior surface of the shell 10. While the cushion member 30 fits within and covers substantially the entire interior surface of the shell 10 (and can further include a lip portion extending slightly beyond the entire interior surface of the shell), it is noted that other embodiments are also possible in which the cushion member covers only a portion of the interior surface of the shell or where the cushion member completely covers the interior surface of and further extends to a portion of the outer surface of the shell.

A cut-out section or window 12 is provided at each lengthwise end 11*a*, 11*b* of the shell 10, where each cut-out section 12 facilitates connection of the shell with a corresponding connection member 5A, 5B. Specifically, each connection member 5A, 5B includes an elongated strap 6 such that the strap passes through the cut-out section. As described herein (in relation to the embodiment of FIG. 7), a strap 6 is configured for connection with a helmet in any conventional or other suitable manner such that the chin strap 2 extends a suitable distance from the helmet to receive and engage with a user's chin when the user is wearing the helmet. The straps 6 can be constructed of any suitably durable and lightweight material (e.g., leather, polyvinyl chloride, etc.) having sufficient flexibility to bend or twist the straps in any suitable manner so as to facilitate a suitable connection with the helmet.

Each strap 6 can connect with the shell 10 in any conventional or other suitable manner, e.g., by looping a portion of the strap 6 through a corresponding cut-out section 12 and then securing two ends of the strap 6 to the helmet in a conventional manner. As shown in FIG. 1B, each strap 6 can include a strap splitter structure 7, located on the strap 6 proximate to the cut-out section 12 of the shell 10 so as to engage and align portions of the strap 6 such that the strap portions extend in diverging directions from each other to space the two strap ends at a suitable distance from each other for engaging with the helmet. In the embodiment depicted in the figures, each strap 6 includes two strap ends, each of which includes a metal snap connector 8 configured to connect to a corresponding metal button disposed at a suitable location on a helmet so as to releasably attach the chin strap 2 to the helmet via the straps at the metal button/snap connection. However, it is noted that any other suitable fastener connection can also be utilized (e.g., hook-and-loop fasteners, strap ties, etc.). Since each strap 6 includes two strap ends with snap connectors 8, the chin strap 2 connects with the helmet at four connection points (two connection points per strap 6). However, it is noted that the chin strap 2 can be configured with any number of straps disposed at each lengthwise end 11*a*, 11*b* of the shell 10 and that connect to a helmet at any selected number of connection points (e.g., two or more connection points) depending upon a particular type of helmet and/or type of application in which the chin strap is used.

The straps 6 can further include any suitable structure that facilitates a lengthwise adjustment of each strap so as to selectively adjust a distance of the chin strap 2 from the helmet. For example, each snap connector 8 can further include a loop adjuster or buckle 9 that selectively and releasably locks a loop portion of the strap 6 in relation to the buckle 9, which in turn selectively adjusts a length dimension between the snap connection of the helmet and a lengthwise end of the shell 10.

Figure 1B:
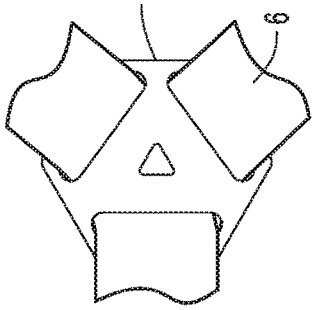
FIG. 1B is a partial bottom view in plan of a connecting strap for the chin strap of FIG. 1A, including the strap splitter.
Figure 2:
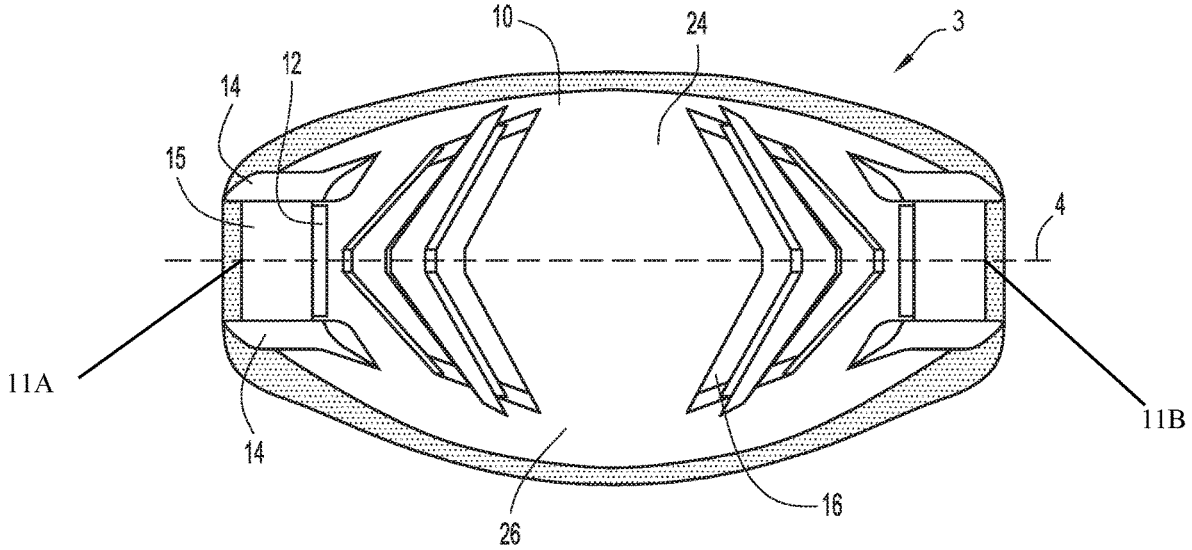
FIG. 2 is a front view in elevation of the chin strap of FIG. 1A without the straps.

The outer shell 10 and underlying cushion member 30 can include corresponding cut-out sections that define openings or grooves 16 extending through the chin strap 2 (as shown in FIGS. 1A and 2). Any suitable number (e.g., one or more), shapes and/or patterns of grooves 16 can be configured in the chin strap 2 to provide a decorative pattern (e.g., arrow shaped grooves as shown in FIGS. 1A and 2) as well as suitable ventilation and cooling as desired (e.g., suitable airflow through the chin strap to provide a cooling effect to the chin during use).

Figure 4:
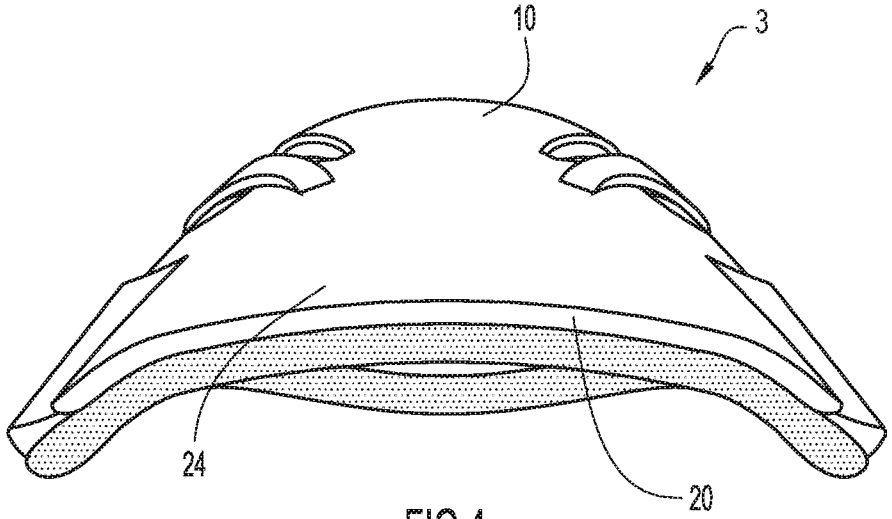
FIG. 4 is a top view in plan of the chin strap of FIG. 2.
Figure 5:
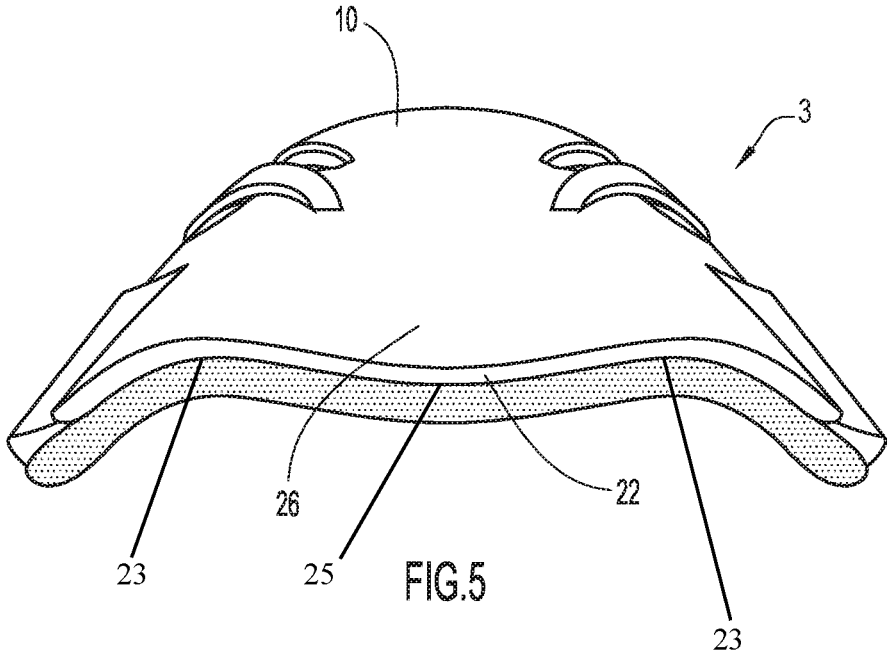
FIG. 5 is a bottom view in plan of the chin strap of FIG. 2.
Figure 6:
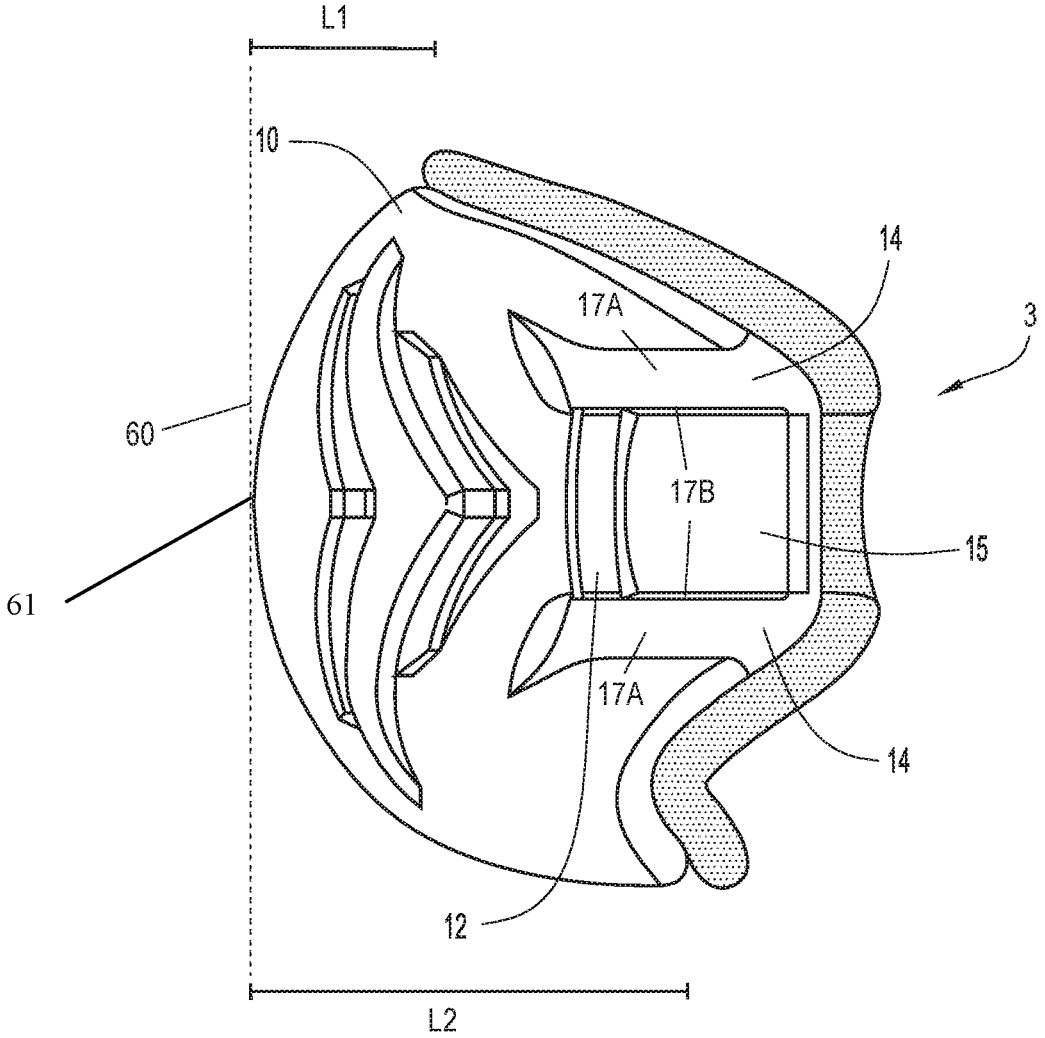
FIG. 6 is a side view in elevation of the chin strap of FIG. 2.

As can be seen in FIGS. 4-6, the shell 10 includes a first or upper edge 20 that is curved and generally concave as it extends the lengthwise dimension (i.e., in a direction along line 4 depicted in FIG. 2) of the shell. The shell 10 further includes a second or lower edge 22 that is curved and generally convex at a central location 25 of the lower edge 22 as the lower edge extends the lengthwise dimension of the shell. At either side of the lower edge 22 between the central location 25 and the lengthwise ends 11*a*, 11*b* of the shell 10, the lower edge 22 has a generally concave profile at locations 23. Thus, extending along the lower edge 22 of the shell 10 from one lengthwise end 11*a* to the other lengthwise end 11*b* (and vice versa), the profile of the lower edge 22 transitions from a concave profile (at a first location 23), to a convex profile (at central location 25), and again to a concave profile (at a second location 23).

When taking a cross-section of the shell 10 on a central axis along its lengthwise dimension, in particular along dashed line 4 shown in FIG. 2, a first or upper shell portion 24 (i.e., the portion of the shell 10 above line 4 in FIG. 2) defines an outer surface area of the shell 10 that is smaller or less than an outer surface area of the shell 10 defined by a second or lower shell portion 26 (i.e., the portion of the shell 10 below line 4 in FIG. 2). Thus, the chin strap 2 is asymmetrical about its lengthwise central axis (defined by dashed line 4), where the lower shell portion 26 includes an extended portion of material (the extended portion of material including the central location 25 of the lower edge 22 including the convex curvature) and has a greater surface area in relation to the upper shell portion 24.

Stated another way, at least a portion of the shell lower edge 22 extends further from the leading forward edge of the cup 3 than at least a portion of the shell upper edge 20. That is, referring to FIG. 6, the length measurement from the leading forward edge of the cup 3 (which is defined as tangent point 61, which lies along dashed tangent line 60 and is the furthest location or furthest distance along the outer convex curvature of the shell 10 from each of its lengthwise ends 11*a*, 11*b*) to the longitudinal or lengthwise center point of the shell upper edge 20, indicated by distance L1, is less than the length measurement from the leading forward cup edge (i.e., defined as tangent point 61 located on line 60) to the longitudinal or lengthwise center point of the shell lower edge 22, indicated by distance L2. Accordingly, when extending an imaginary plane in a direction between the upper and lower shell edges and that is parallel to line 60, at least the lengthwise center point of the shell lower edge 22 does not lie in the same plane as at least the lengthwise center point of the shell upper edge 20. In an embodiment, one or more locations along the shell lower edge 22 (e.g., a location at the lengthwise center point of the lower edge, which includes the convex contour 25) may extend (from the leading forward cup edge) 10-25 mm (millimeters) further than one or more locations along the shell upper edge 20 (e.g., a location at the lengthwise center point of the upper edge). For example, one or more locations along the shell lower edge 22 (e.g., a location at the lengthwise center point of the lower edge, which includes the convex contour 25) may extend (from the leading forward cup edge) as much as 14 mm-23 mm further from a corresponding one or more locations along the shell upper edge 20 (e.g., a location at the lengthwise center point of the upper edge). In another example embodiment, one or more locations along the shell lower edge 22 (e.g., a location at the lengthwise center point of the lower edge, which includes the convex contour 25) may extend (from the leading forward cup edge) as much as 17 mm-20 mm (from the forward cup edge) further from a corresponding one or more locations of the shell upper edge 20 (e.g., a location at the lengthwise center point of the upper edge).

This asymmetrical configuration, including extension of the shell lower edge beyond the shell upper edge in this manner and to the degree as described herein (e.g., from 10-25 mm, from 14-23 mm, or from 17-20 mm), provides more engaging or contact surface area between the chin strap 2 and the chin of a user wearing the chin strap at the lower chin strap portion beneath the user's chin in relation to other known chin straps. The changing profile of the shell lower edge 22 (from locations 23 having a concave curvature to central location 25 having a convex curvature) also enhances alignment of the lower edge 22 along and underneath the user's chin (e.g., with the central location 25 of the shell lower edge 22 fitting directly under and at a central portion of the user's chin). This configuration of the chin strap 2 further helps to secure the position of the chin strap 10 on the user's chin, preventing or significantly limiting movement of the chin strap in relation to the user's chin during use and even in scenarios in which the chin straps 6 are adjusted to be loosely fastened such that the chin strap 2 is not pulled tight but instead lies loose along the user's chin.

The cushion member 30 is secured to an inner or interior surface of the shell 10 that opposes its outer surface. The cushion member 30 has a geometric configuration that generally corresponds with the shell. The cushion member 30 can be secured in any suitable manner to the interior surface of the shell 10 (e.g., via a suitable adhesive and/or any other suitable fastener). In particular, the cushion member 30 has an upper cushion member portion 32 and a lower cushion member portion 34 that are defined by the central lengthwise axis line 4 of the chin strap 2. The lower cushion member portion 34 corresponds with lower shell portion 26 and the upper cushion member portion 32 corresponds with the upper shell portion 24, where the lower cushion member portion 34 has a greater contact surface area to engage with a user's chin in relation to the upper cushion member portion 32. An interior (chin-facing) surface of the cushion member 30 has a generally curved and concave contour extending the lengthwise dimension of the chin strap 2, where the contour of the interior surface is configured to generally conform to a user's chin placed within the chin strap.

Figure 3:
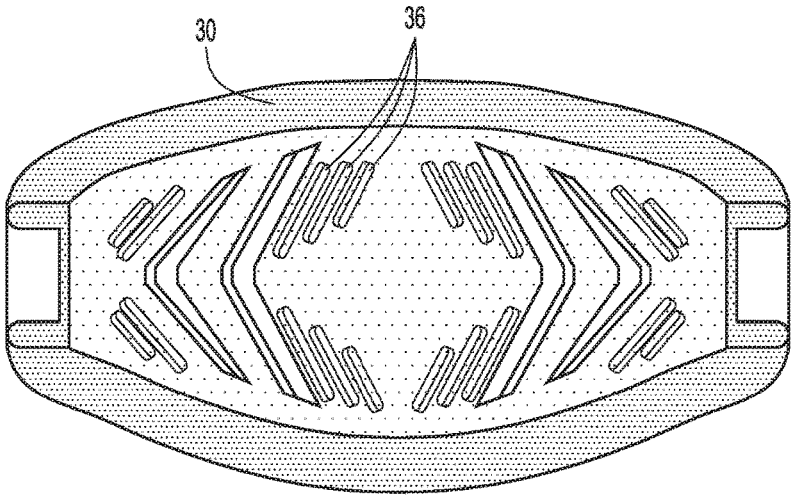
FIG. 3 is a rear view in perspective of the chin strap of FIG. 2.

As previously noted, the cushion member 30 is constructed of a suitably soft, flexible and compressible material, since the cushion member 30 is configured to engage the user's chin during use of the chin strap 2. As shown in FIG. 3, a series of slightly raised and elongated protrusions 36 extend from the exterior surface of the cushion member 30 (i.e., the surface of the cushion member that engages with a user's chin when the user is wearing the chin strap) at different locations along the exterior surface. In the example embodiment of FIG. 3, the protrusions 36 are elongated and linear with a pattern of two or more elongated protrusions aligned with one or more ventilation grooves 16. However, protrusions can be provided on the exterior surface of the cushion member having other suitable shapes and dimensions and can further be arranged in other suitable patterns along the exterior surface. The protrusions 36 are suitably dimensioned and arranged along the exterior surface of the cushion member 30. The protrusions 36 serve as spacing members, providing a slight gap or distance between the skin of the user's chin and a portion or the entire interior surface area of the cushion member 30, thus significantly preventing or inhibiting sticking or a suction-like engagement between the user's chin and the cushion member 30 during use of the chin strap 2.

The chin strap 2 can be provided with further features that allow for a secure and comfortable engagement of the chin strap with a user's chin during use. In particular, the outer shell 10 can include raised ridges 14 disposed at the lengthwise ends of each cut-out section 12 for the straps 6 (i.e., the ridges 14 are spaced apart at least the length of the cut-out section 12). In particular, each cut-out section 12 has a lengthwise dimension that is transverse the lengthwise dimension of the shell 10 (e.g., transverse line 4), whereas each raised ridge 14 has a lengthwise dimension that corresponds with (i.e., extends in the same general direction as) the lengthwise dimension of the shell 10 and is located on either side of the lengthwise ends of the cut-out section 12 (i.e., the cut-out section 12 lies between each raised ridge 14 on each side of the shell 10). Each raised ridge 14 further comprises a ramped surface 17A that extends away from the outer contour of the shell 10 to an edge surface 17B located at the cut-out section 12. The edge 17B of each raised ridge 14 further extends along the lengthwise dimension of the raised ridge and toward a lengthwise end of the shell 10. A recessed lower surface or depression 15 within the outer surface contour of the shell 10 is defined between the edges 17B of the two ridges 14 as well as between the cut-out section 12 and the lengthwise end 11*a*, 11*b* of the shell 10. When a strap 6 is inserted through a cut-out section 12 of the shell 10, a portion of the strap extending around the outer surface of the shell 10 is positioned within the depression 15 and between the two raised ridges 14, such that the ridges 14 and depression 15 define a channel within the outer surface of the shell for the strap 6. The channel that is defined and bounded by the ridges 14 prevents or significantly limits lateral movements of the strap 6 at its connection with and in relation to the lengthwise dimension of the chin strap 2 when the strap is secured to the chin strap at the cut-out section 12, which further enhances the effectiveness of the connection between the chin strap and the helmet. The ridges 14, furthermore, function as structural members (robs or gussets), adding strength and rigidity to the outer shell 10.

Figure 7:
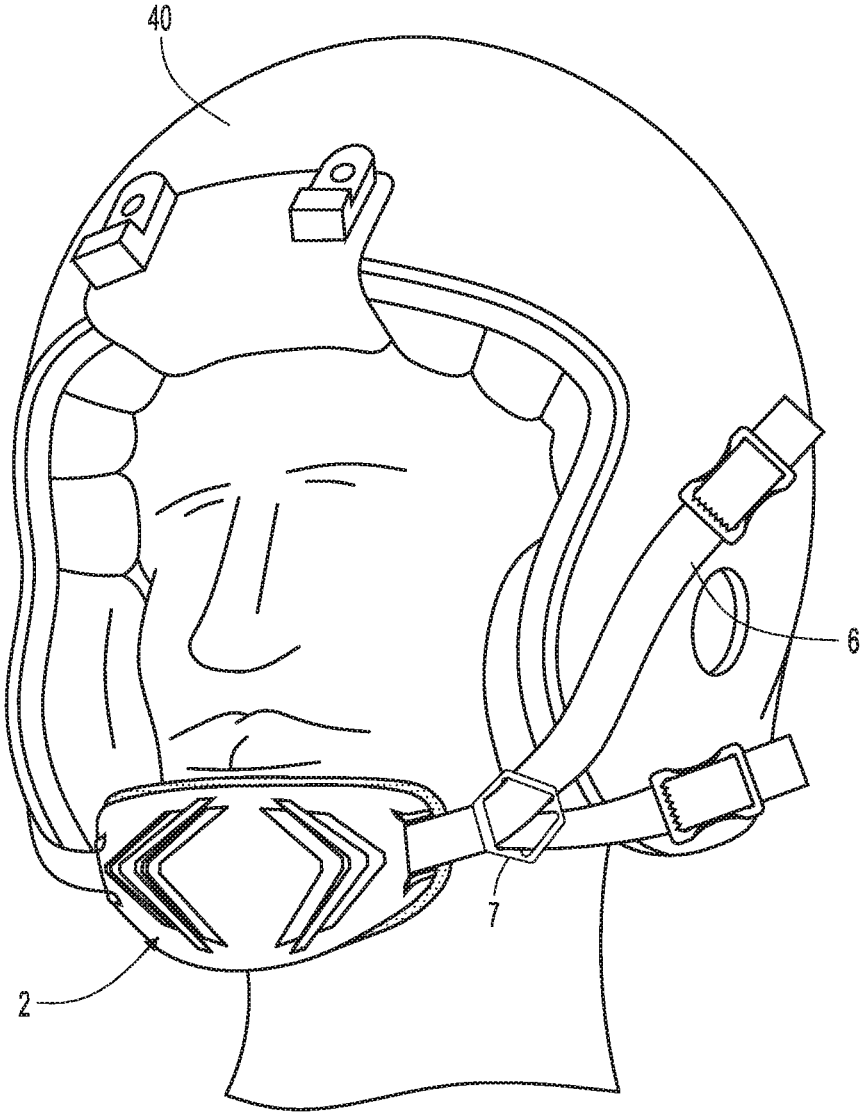
FIG. 7 is a view in perspective of an example embodiment of a head gear protection device including a helmet and the chin strap of FIG. 1A secured to the helmet.

Operation of the chin strap 2 is now described with reference to FIGS. 1-7. Referring to FIG. 7, a head gear protection device includes the chin strap 2 of FIGS. 1-6 secured to a helmet 40 via the straps 6 (e.g., using the metal button/snap connection as previously described herein). Any suitable helmet 40 can be utilized (e.g., a football helmet, a hockey helmet, a lacrosse helmet, a police/riot gear helmet, etc.) for connection with the chin strap 2, so long as the helmet includes connection structure that corresponds with the connection structure provided on the ends of the straps 6 of the chin strap. Generally, the helmet 40 is configured to fit around at least a portion of a user's head and is constructed of a suitably hard yet relatively lightweight material to absorb and/or disperse forces applied to the helmet such that such there is less impact of such applied forces to the user's head.

The chin strap 2 is preferably aligned for connection with the helmet 40 such that the first or upper shell portion 24 is positioned to extend above the user's chin while the lower shell portion 26 is positioned such that at least some of this portion 26 (including the central location 25 of the lower edge 22) extends below the user's chin. This configuration establishes an extended engaging contact surface between the chin strap 2 and an area beneath the user's chin. Each strap 6 is also secured within the channel defined by ridges 14 and depression 15 so as to prevent or significantly limit transverse movements of the strap 6 at its connection with the chin strap 2. The length of each strap 6 can be adjusted using its corresponding buckle 9 so that the user can modify how loose or tight the chin strap 2 is engaged with the user's chin.

During a physical activity, when a user encounters a force applied to the chin strap, the hard outer shell 10 and inner cushion member 30 disperse and absorb the force such that the applied force is not translated entirely to the user's chin (e.g., only a smaller portion or none of the applied force is applied to the user's chin). Further, the extended surface areas of the lower shell portion 26 and lower cushion member 34 in relation to the upper shell portion 24 and upper cushion member 32 prevent or significantly limit disengagement of the chin strap 2 from the user's chin even in scenarios in which the chin strap is loosely engaged around the user's chin (e.g., the straps 6 are adjusted via the buckles 9 such that the chin strap is not pulled very tight to the user's chin). The protrusions 36 on the interior surface of the cushion member 30 also prevent or limit the chin strap 2 from engaging in a suction tight fit with the user's chin.

With the above-described configuration, a chin strap is provided having a more secure fit on the user. For example, if the helmet is repositioned on the head via an outside force (during game play), the asymmetrical configuration including the extended cup wall will retain the helmet on the head (i.e., the chin strap of the invention is more effective at retaining the helmet on the head compared to conventional symmetrical chin straps). Additionally, the chin strap of the present invention ensures protection for the user's chin even in scenarios in which the user chooses to adjust the chin strap to a very loose engagement with his or her chin.

While the invention has been described in detail and with reference to specific embodiments thereof, it will be apparent to one skilled in the art that various changes and modifications can be made therein without departing from the spirit and scope thereof. For example, the cushion member or the shell may be eliminated. Additionally, when both the shell and the cushion member are present, only one component may be asymmetrical, with the other being symmetrical. The chin strap, moreover, may be formed of fabric. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. A chin strap comprising:

a rigid protective shell including an outer surface that faces away from a user's chin during use of the chin strap, the outer surface including a curved and convex contour extending between lengthwise ends of the shell, the shell further including a first curved edge extending between the lengthwise ends along a top edge portion of the shell and a second curved edge extending between the lengthwise ends along a bottom edge portion of the shell that extends below the user's chin during use of the chin strap, wherein the first curved edge includes a concave contour, the second curved edge includes a convex contour, the convex contour of the second curved edge is centrally located along the second curved edge, and at least a portion of the second curved edge of the shell extends further in distance L2 from a leading forward edge of the convex contour for the outer surface of the shell in relation to a distance L1 for the first curved edge of the shell, the distance L1 being measured by a line that extends between a tangent line defined at the leading forward edge and a lengthwise center point of the first curved edge, and the distance L2 being measured by a line that extends between the tangent line and a lengthwise center point of the second curved edge.

2. The chin strap of claim 1, wherein a cross-section along a lengthwise central axis of the chin strap defines first and second outer surface shell portions that are asymmetrical such that the first outer surface shell portion of the cross-section including the first curved edge defines a first area that is less than a second area defined by the second outer surface shell portion of the cross-section including the second curved edge.

3. The chin strap of claim 1, further comprising straps coupled to lengthwise ends of the shell, wherein the straps are further configured to connect with a helmet such that the chin strap is aligned to engage with a user's chin when the user is wearing the helmet.

4. The chin strap of claim 3, wherein the straps are configured to connect with the helmet such that a portion of the outer surface of the shell including a portion of the second curved edge is disposed beneath the user's chin.

5. The chin strap of claim 1, further comprising:

a cushion member secured to an inner surface of the shell that opposes the shell outer surface, wherein the cushion member includes a surface including a curved and concave contour that extends between lengthwise ends of the cushion member such that the cushion member engages with the user's chin during use of the chin strap.

6. The chin strap of claim 5, wherein the cushion member comprises compressible material.

7. The chin strap of claim 5, wherein the cushion member includes at least one raised protrusion extending from the surface of the cushion member so as to engage a user's chin when the chin strap is placed over the user's chin.

8. The chin strap of claim 1, further comprising a cut-out section extending through and located proximate a lengthwise end of the shell, the cut-out section being suitably dimensioned to facilitate looping of a strap through the cut-out section.

9. The chin strap of claim 8, further comprising a channel defined on the outer surface of the shell and extending from the cut-out section toward the lengthwise end of the shell.

10. The chin strap of claim 9, wherein the channel is defined by two spaced apart ridges extending from the outer surface of the shell in a direction from the cut-out section toward the lengthwise end of the shell, the ridges being spaced apart from each other at least the length of the cut-out section.

11. The chin strap of claim 1, wherein at least a portion of the second curved edge of the shell extends further in distance from the leading forward edge of the shell than at least a portion of the first curved edge of the shell by an amount of 10-25 mm.

12. A head gear protection device comprising:

a helmet configured to fit around at least a portion of a user's head; and the chin strap of claim 1.

13. The chin strap of claim 1, wherein the second curved edge further includes a first concave contour located between a first lengthwise end of the shell and the centrally located convex contour of the second curved edge and a second concave contour located between a second lengthwise end of the shell and the centrally located convex contour of the second curved edge, and a cross-section along a lengthwise central axis of the chin strap defines a first shell portion including the first curved edge and a second shell portion including the second curved edge.

14. The chin strap of claim 13, further comprising:

a cushion member secured to an inner surface of the shell that opposes the shell outer surface, wherein the cushion member includes a surface including a curved and concave contour that extends between lengthwise ends of the cushion member such that the cushion member engages with the user's chin during use of the chin strap.

15. The chin strap of claim 14, wherein:

the first shell portion of the cross-section defines a first surface area between the lengthwise central axis and the first curved edge;

the second shell portion of the cross-section defines a second surface area between the lengthwise central axis and the second curved edge; and the first surface area is less than the second surface area.

* * * * *